United States Patent [19]

Langen et al.

[11] Patent Number: 4,688,300

[45] Date of Patent: Aug. 25, 1987

[54] APPARATUS FOR CAN CHANGING

[75] Inventors: Manfred Langen, Monchen-Gladbach; Ferdinand Leifeld, Kempen, both of Fed. Rep. of Germany

[73] Assignee: Trützschler GmbH & Co. KG, Monchen-Gladbach, Fed. Rep. of Germany

[21] Appl. No.: 905,264

[22] Filed: Sep. 9, 1986

[30] Foreign Application Priority Data

Sep. 10, 1985 [DE] Fed. Rep. of Germany ..... 3532172

[51] Int. Cl.[4] ..... D01H 9/18

[52] U.S. Cl. ..... 19/159 A

[58] Field of Search ..... 19/159 R, 159 A

[56] References Cited

U.S. PATENT DOCUMENTS 3,884,026 5/1975 Yoshizawa et al. ..... 19/159 A 4,012,893 3/1977 Weber ..... 19/159 A

*Primary Examiner*—Louis K. Rimrodt

*Attorney, Agent, or Firm*—Spencer and Frank

[57] ABSTRACT

An apparatus for automatically transporting at least one can between a sliver delivering spinning industry machine, e.g. a carding machine, and a sliver fed spinning industry machine, e.g. a drawing frame, by means of a transporting carriage. In order to improve loading and unloading as well as transport of the spinning cans, the carriage control, the carding machine control device and the drawing frame control device are connected with a central control unit.

10 Claims, 6 Drawing Figures

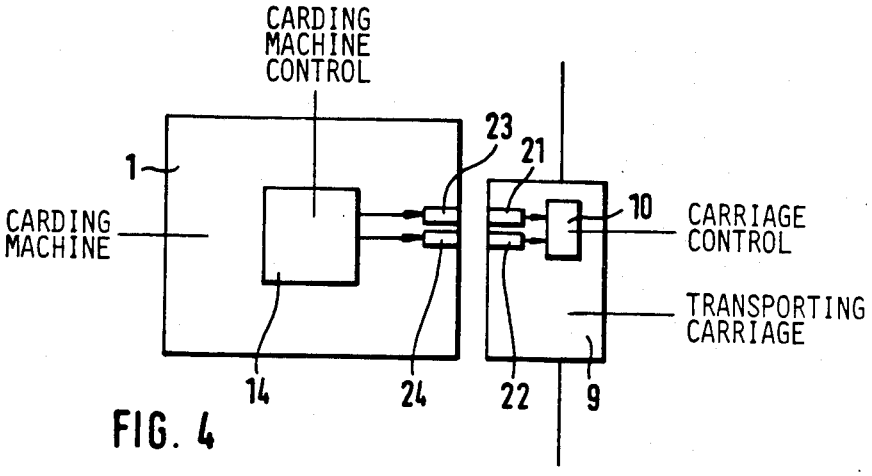
FIG. 4
FIG. 5
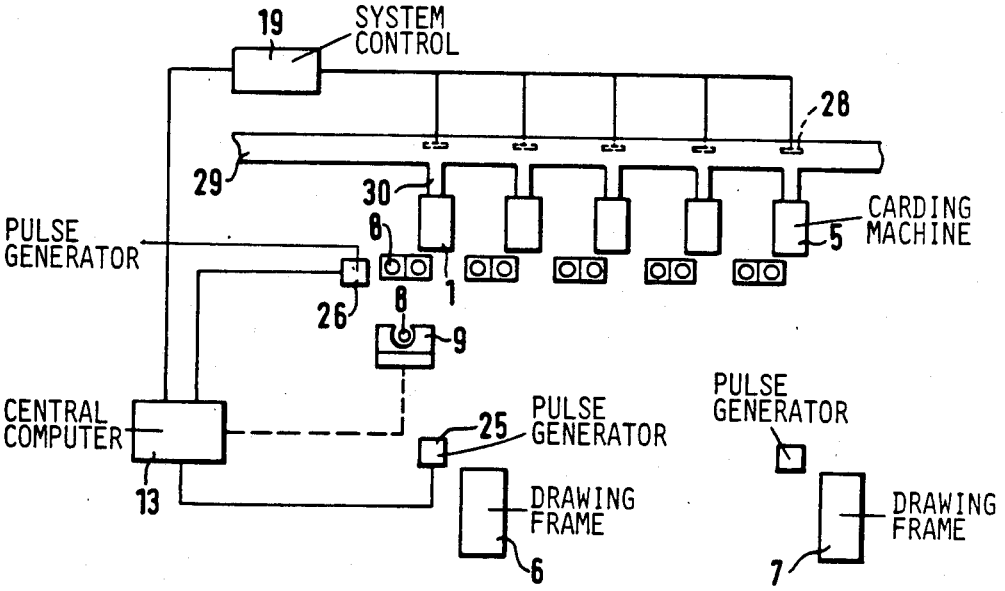

APPARATUS FOR CAN CHANGING

BACKGROUND OF THE INVENTION

The present invention relates to an apparatus for automatically transporting, by means of a transporting carriage, at least one can between a sliver furnishing spinning industry machine, e.g. a carding machine, and a sliver fed spinning industry machine, e.g. a drawing frame.

In a known device, two handles are disposed on opposite sides of a sliver can (spinning can) to push the can onto the carriage. Then the carriage is manually pushed from the carding machine to the drawing frames. This makes the machine dependent on personnel, i.e. it is not possible to reliably displace the spinning cans and the transporting carriage with this device. There is the additional drawback that loading and unloading of the cans and their transport cannot be performed with a single device.

SUMMARY OF THE INVENTION

It is therefore an object of the invention to provide an apparatus of the above-mentioned type which avoids the stated drawbacks and which permits, in particular, loading and unloading as well as transport of the spinning cans in a simple and operationally reliable manner.

The objects of the invention are obtained by the present apparatus which automatically transports at least one can between a sliver furnishing spinning industry machine and a sliver fed industry machine. The apparatus comprises: a transporting carriage operatively associated with the sliver furnishing and sliver fed machines for transporting the can between the machines; a first electronic control means connected to the carriage for controlling its operation; second electronic means connected to the sliver furnishing machine for controlling its operation; and a central control unit connected to the first, second and third control means for supplying control signals thereto.

With the measures according to the invention, an automatically controlled transporting carriage is provided for at least one can. The significant feature is the linkage of the carriage control with the controls for the carding machine and the drawing frame via the central control device (central computer). This linkage permits automatic operation, inter alia, in the following process steps: the drawing frame signals, e.g. by means of pulse generators, to the central control device that the drawing frame is ready to receive the cans, the carding machine signals, e.g. by means of pulse generators, to the central control device that a can filled with sliver is available, the central control device signals to the control for the transporting carriage that it should start traveling to the carding machine, receive the can at the carding machine, transport it from the carding machine to the drawing frame and discharge the can at the drawing frame.

The transporting carriage is associated with a central computer which determines the path lengths and targets of the carriage. The computer is in communication with the stations to be approached (carding machine, drawing frame, possibly a reserve station) and with the carriage and receives pulses from the stations. Every station to be approached is connected with all other stations via the traveling paths. The computer is able to determine different paths for the carriage. The general travel program, i.e. the association of supply stations (e.g. carding machine) and target stations (e.g. drawing frame) - in the sense of regulating the flow of material with respect to the sliver to be transported - is put in manually. This input may change. For example, the cans from three carding machines may be delivered to one drawing frame and those from four other carding machines may be delivered to a second drawing frame. This would be expedient, for example, if a Flexafeed system is involved. FLEXAFEED is a trademark of/and is manufactured by Trützschler GmbH & Co. KG, D-4050 Mönchengladbach, Federal Republic of Germany. However, changing the travel program can also be effected automatically as a function of the position of the Flexafeed flaps. Or, switching may be effected automatically by a higher order control system.

Preferably, the control receives a preliminary signal derived from the fill level of the can while the can is being filled at the carding machine. This preliminary signal can be evaluated to set up a waiting line in the computer. The control receives a signal once the change of cans at the carding machine has been completed by the can changing mechanism.

The above-mentioned signals actuate the start of travel of the carriage to pick up the full can from the carding machine. Between the carding machine and the drawing frame, a buffer (reserve station) is established for the cans. A buffer may be established for full cans and also for empty cans. The carriage may travel on a direct path from the carding machine to the drawing frame and vice versa or to the buffer. At the drawing frame, the carriage is able to approach different, predetermined positions (depository locations). The computer control makes it possible for cans from fixed positions at the individual carding machines to be transported to fixed, predetermined positions at the drawing frame. Position association between the cards and the depository positions at a drawing frame can be selected and changed. The association can be changed by way of a program. The associations of a plurality of carding machines and a plurality of drawing frames can be preselected and changed.

The association between carding machines and drawing frames may be coupled with the position of the Flexafeed flaps in a Flexafeed system associated with a carding machine feeding system. If the carding machine system is switched (the Flexafeed flap positions are changed) the coupling by way of the computer automatically determines the association between the carding machines and the drawing frames.

In simple systems, the central computer may also be accommodated in the carriage. Accommodation in the carriage is of advantage because the transfer of data is then simpler and thus the costs for hardware and software are reduced.

The data connections between the machines (carding machine, drawing frame), the transporting carriage and the computer may be transmitted, for example, by radio or by means of infrared light. The machine control of the drawing frame and/or of the carding machine is in data exchange with the central computer. Data indicating the quality of the fiber materials produced on the machines may be fed to the computer. A comparison of quality features can be utilized to reject materials having undue tolerance deviations and this can be done automatically by way of the transporting system.

Such data can also be utilized to compensate for the deviations of slivers from different cans. For example, cans having positive and negative deviations are selected and transported jointly to the drawing frame so that a preliminary optimization takes place in the machine. Generally, the transporting system in conjunction with the computer is able to sort the sliver cans into various quality classes by keeping the product within tolerances.

BRIEF DESCRIPTION OF THE DRAWINGS

The invention will now be described in greater detail below with reference to embodiments which are illustrated in the drawings.

FIG. 4 shows a block circuit diagram of an arrangement of sensors at the transporting carriage and at the carding machine.

FIG. 5 shows a schematic diagram of an apparatus according to the invention in which the central computer is in communication, via the system control, with the actuating devices for the Flexafeed flaps.

DESCRIPTION OF THE PREFERRED EMBODIMENTS

Figure 1:
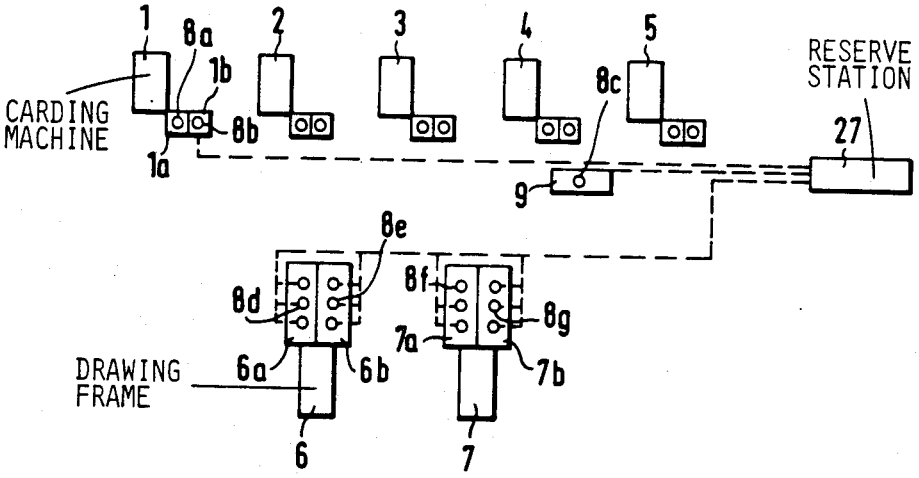
FIG. 1 is a schematic top view of a spinning industry machine comprising five carding machines and two drawing frames and employing a movable can transporting device.

The spinning preparation device shown in FIG. 1 includes five carding machines 1 to 5 and two drawing frames 6 and 7, which are shown schematically. Each carding machine 1 to 5 has an associated feeding device 1*a* for feeding the slivers into a spinning can 8*a*. In addition to feeding device 1*a*, there is also provided a pickup station 1*b* where the spinning cans 8*b* filled with card sliver can be deposited. Feeding device 1*a* and pickup station 1*b* may be part of a known can changing device, e.g. from the U.S. Pat. No. 3,354,513.

To transport can 8*c* between carding machines 1 to 5 and drawing frames 6 and 7, a transporting carriage 9 is provided which transports can 8*c* to reservoir station 6*a* of drawing frame 6 or to reservoir station 7*a* of drawing frames 6 and 7. The six spinning cans (reserve position) marked 8*d* and 8*f*, respectively, are disposed at the same level as six further filled spinning cans 8*e* and 8*g*, respectively. Filled spinning cans 8*e* and 8*g* are disposed at the inlet of drawing frames 6 and 7, respectively, where the carding machine slivers are removed from them and are fed to the drawing mechanisms of drawing frames 6 and 7, respectively, for multiple filament production and decoration. It is understood that instead of two spinning cans 8*e* and 8*g*, a larger or smaller number of spinning cans can be placed simultaneously at the inlet of drawing frames 6 and or 7 if a different type of multifilament design is desired. The reference numeral 27 identifies a reserve station (buffer) for spinning cans 8 which is disposed between the carding machine and the drawing frame and is able to accommodate full and/or empty cans, as required. The traveling path of transporting carriage 9 is shown in dashed lines.

Figure 2:
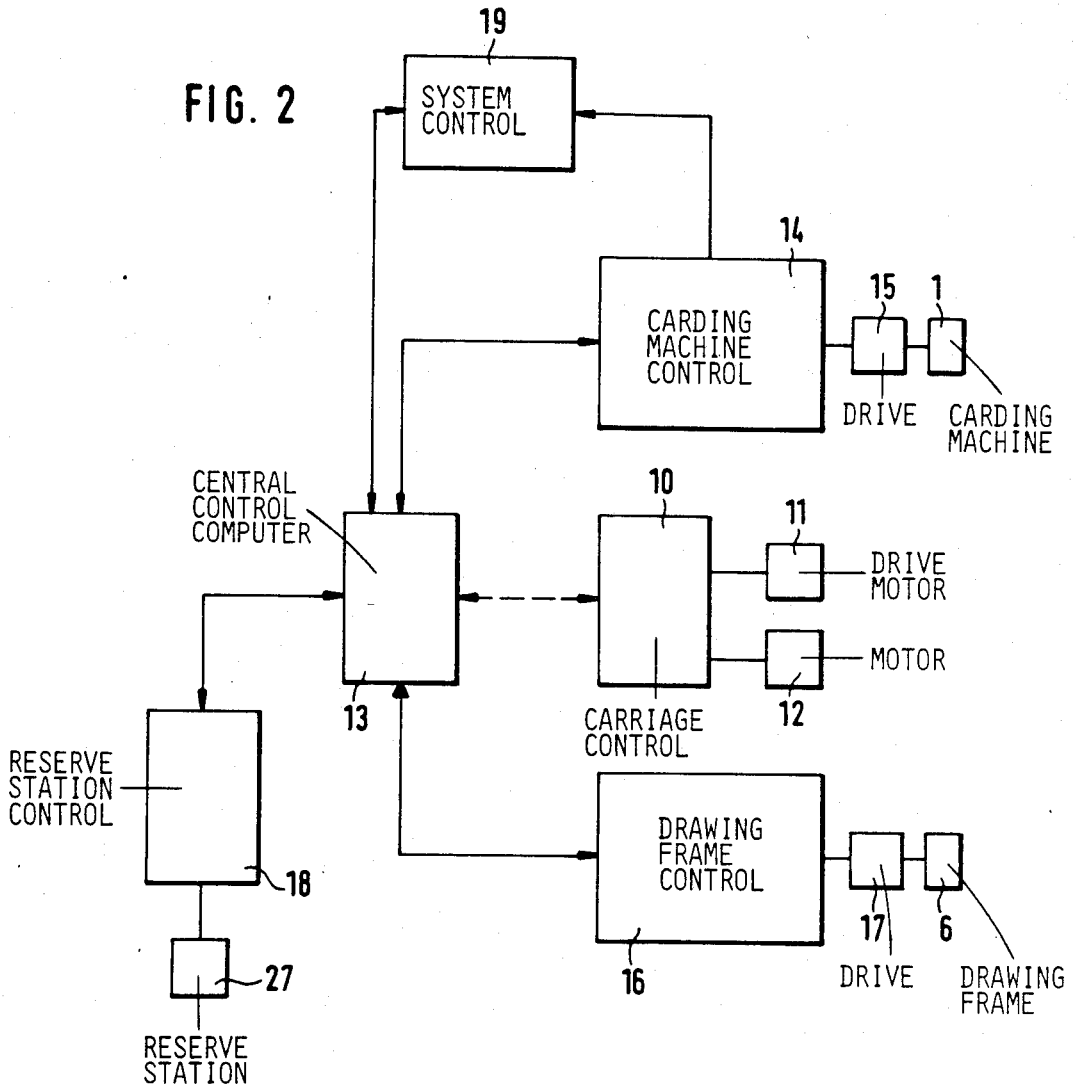
FIG. 2 is a block circuit diagram of the apparatus according to the invention.

According to FIG. 2, carriage control 10 is in communication with a drive motor 11 for driving the carriage and with a motor 12 for driving the steering mechanism. The carriage control 10 is in communication, as shown by the dotted line, by means of infrared light with the central computer 13 (microcomputer and microprocessor). Central computer 13 is also connected with the carding machine control 14 (to which are connected the drives 15 for carding machine 1 and the can changing mechanism) and with the drawing frame control 16 (to which are connected the drives 17 for drawing frame 6). Central computer 13 is additionally connected with a reserve station control 18 (buffer control) for can reserve station 27.

Moreover, central computer 13 is in communication with the carding machine 14 by way of blow room control 19.

Figure 3:
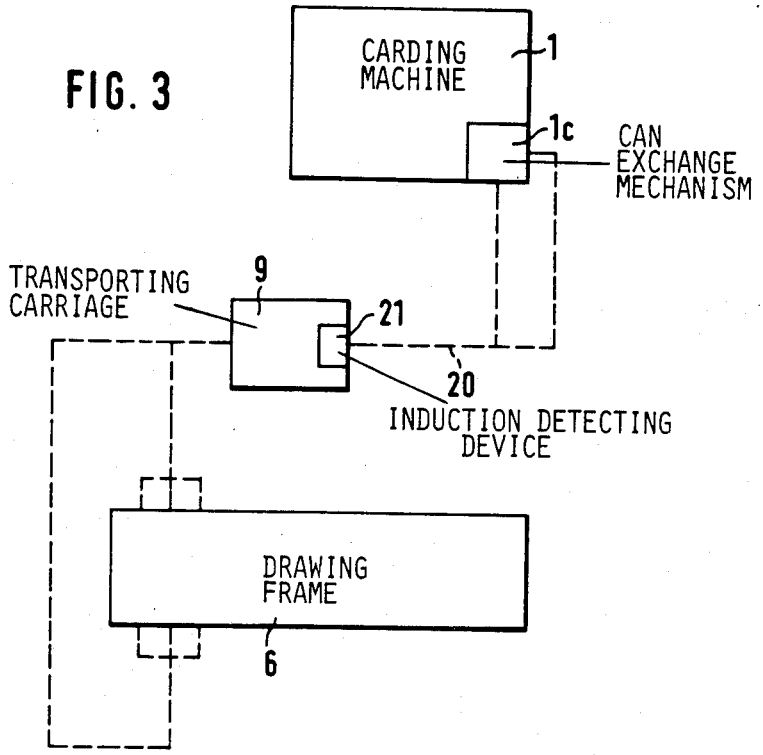
FIG. 3 shows a block circuit arrangement of an induction loop between the carding machine and the drawing frame for guiding the transporting carriage.

According to FIG. 3, and induction loop 20 is provided between carding machine 1 or, more precisely, the can exchange mechanism 1*c* and this induction loop is disposed, for example, below the factory floor. Transporting carriage 9 is provided with an induction detecting device 21.

Figure 3A:
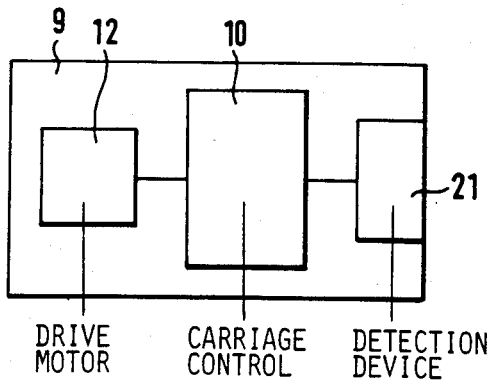
FIG. 3*a* shows a block diagram of the connection of the detection device for the induction loop with the steering of the carriage.

According to the embodiment of FIG. 3*a*, detection device 21 is in communication via carriage control 10 with drive motor 12 for the carriage steering mechanism.

According to the embodiment of FIG. 4, transporting carriage 9 is provided with carriage control 10 and sensors 21, 22 are disposed at transporting carriage 9 and are in communication with the carriage control 10. Two sensors 23, 24 are attached to carding machine 1 or, more precisely, to the associated can exchange mechanism and are in communication with carding machine control 14. In this way, transporting carriage 9 is able to distinguish between full and empty cans 8 and full and empty depository positions at carding machines 1 to 5 (or at the associated can exchange mechanisms) at drawing frames 6, 7 and in reserve station 27.

According to FIG. 5, drawing frame 6 has an associated pulse generator 25 and carding machine 1 has an associated pulse generator 26, with pulse generators 25 and 26 being in communication with central computer 13. Via the system control 19, central computer 13 is in communication with the actuating devices (not shown) for the Flexafeed flaps 28 associated with the feed and distributor conduit 29 for the carding machine feed mechanism 30. By associating the position of the Flexafeed flaps 28 with the central computer 13, the latter automatically calculates new (adapted) paths and new targets for transporting carriage 9 as a function of the position of Flexafeed flaps 28.

The present invention is described for the example of a carding machine as the sliver delivering spinning industry machine and a drawing frame as the sliver fed spinning industry machine. The invention can be utilized in a similar manner, for example, for a drawing frame or a flyer as the sliver delivery spinning industry machine and a flyer or a spinning machine as the sliver fed spinning industry machine and includes such machines.

The Central Control (Computer) may be e.g. a TMS model with microprocessor Rockwell 6502, manufactured by Trützschler GmbH & Co. KG, Mönchengladbach, Federal Republic of Germany.

The present disclosure relates to the subject matter disclosed in FRG Application No. P 35 32 172.5 filed Sept. 10, 1985, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. An apparatus for automatically transporting at least one can between a sliver furnishing spinning industry machine and a sliver fed spinning industry machine, comprising:

a transporting carriage operatively associated with said sliver furnishing and sliver fed machines for transporting the can between said machines;

first electronic control means connected to said carriage for controlling its operation;

second electronic control means connected to said sliver furnishing machine and to said sliver fed machine for controlling the operation of said machines and for receiving from at least one of said machines condition signals indicative of the operating state of said one machine; and a central control unit connected to said first and second control means for receiving the condition signals from said second control means and for supplying control signals to said first electronic control means for controlling the transport of the can between said machines in dependence on the condition signals.

2. Apparatus as defined in claim 1, further comprising a buffer control connected to said central control unit.

3. Apparatus as defined in claim 1, further comprising a system control device in communication with said second electronic control means and said central control unit. device.

4. Apparatus as defined in claim 1, wherein said transporting carriage includes a detection device which allows said transporting carriage to travel along a stationary induction loop.

5. Apparatus as defined in claim 4, wherein said detection device is in communication with said central control unit via said first electronic control means.

6. Apparatus as defined in claim 5, wherein said detection device comprises at least one sensor disposed on said transporting carriage and in communication with said first electronic control means.

7. Apparatus as defined in claim 1, further comprising a motor for steering said transporting carriage, said motor being in communication with said central control unit via said first electronic control means.

8. Apparatus as defined in claim 1, wherein said sliver furnishing industry machine includes an exchanging mechanism and at least one sensor, said at least one sensor being disposed at said exchanging mechanism and in communication with said second electronic control means.

9. Apparatus as defined in claim 1, wherein said sliver fed industry machine has at least one sensor which is in communication with said second electronic control means.

10. Apparatus as defined in claim 1, wherein said sliver furnishing spinning industry machine is a carding machine and said sliver fed spinning industry machine is a drawing frame.

* * * * *